United States Patent [19]

McMahan et al.

[11] Patent Number: 5,064,195

[45] Date of Patent: Nov. 12, 1991

[54] NOVELTY BASKETBALL GOAL PRODUCING SOUND EFFECTS ON MADE SHOT

[75] Inventors: David S. McMahan, Huntersville, N.C.; Richard Tso; Jackson Lee, both of Taipei, Taiwan

[73] Assignee: Express Yourself, Inc., Charlotte, N.C.

[21] Appl. No.: 672,952

[22] Filed: Mar. 21, 1991

[51] Int. Cl.[5] ..... A63B 63/08

[52] U.S. Cl. ..... 275/374; 273/1.5 R; 273/402

[58] Field of Search ..... 273/1.5 R, 402, 85 R, 273/85 B, 374, 375

[56] References Cited

U.S. PATENT DOCUMENTS

| | | | |
|---|---|---|---|
| 2,085,206 | 6/1936 | Holmdahl | 273/1.5 R |
| 2,192,430 | 3/1940 | Branner | 273/1.5 R |
| 2,413,952 | 1/1947 | Chervenka | 273/1.5 R X |
| 2,517,463 | 8/1950 | Cobb | 273/1.5 R |
| 2,534,067 | 12/1950 | Rubin | 273/1.5 R |
| 2,999,233 | 9/1961 | Dresbach et al. | 273/1.5 R |
| 3,244,420 | 4/1966 | Poynter | 273/402 |
| 3,375,004 | 3/1968 | Ebstein | 273/1.5 R |
| 3,788,642 | 1/1974 | Matras et al. | 273/1.5 R |
| 3,825,256 | 7/1974 | Ochi | 273/86 B X |
| 3,825,257 | 7/1974 | Palmer | 273/1.5 A |
| 4,013,292 | 3/1977 | Cohen et al. | 273/85 R |
| 4,199,141 | 4/1980 | Garcia | 273/26 A |
| 4,333,657 | 6/1982 | Jaworski et al. | 273/376 |
| 4,480,833 | 11/1984 | Barcelow et al. | 273/85 B |

OTHER PUBLICATIONS

Brochure-Breez Electronics, Division of Express Yourself, Inc., 6601 N. Northpark Blvd., Charlotte, North Carolina, 28211.
Side of Box-Deluxe Waste.Basket.Ball TM.

*Primary Examiner*—Paul E. Shapiro
*Attorney, Agent, or Firm*—Bell, Seltzer, Park & Gibson

[57] ABSTRACT

A novelty basketball goal producing a predetermined pattern of sound effects, such as crowd cheers and applause, responsive to a made shot. The goal includes a force activated sensor suspended within the net of the goal by the wires which connect the sensor to the sound effects generating means. The sensor will contact an object passing through the hoop thereby triggering the sound effects generator. The sensor is preferably a self-contained electrical switch having a housing and two conductors positioned therein. One of the conductors is suspended within the housing so that a force applied thereto causes the conductors of the switch to come into electrical contact. A inexpensive and readily manufactured novelty basketball goal with sound effects is provided by the simple force activated sensing arrangement. The backboard of the goal may include a clip for mounting to a vertical surface, such as the rim of a waste paper basket. The hoop may also be pivotally connected to the backboard so that the hoop may be folded against the backboard to facilitate storage and carrying of the goal.

15 Claims, 3 Drawing Sheets

NOVELTY BASKETBALL GOAL PRODUCING SOUND EFFECTS ON MADE SHOT

FIELD OF THE INVENTION

The present invention relates to the field of amusements and games and more particularly to a novelty basketball goal which produces sound effects including cheering in response to a made shot.

BACKGROUND OF THE INVENTION

Many people in the United States, and most modern countries, have a certain fascination, if not addiction, to college and professional sports of almost all types. Basketball, in particular, is a very popular sport with a large number of recreational players and even larger following of enthusiastic spectators. The enthusiasm for basketball carries over into daily life, even into work place routine. Most people can obtain a certain satisfaction when successfully tossing an object into a designated goal whether it be a regulation basketball into a regulation goal or a crumpled ball of waste paper into a waste basket.

A number of relatively sophisticated and expensive basketball related game products have been developed. For example, U.S. Pat. No. 4,013,292 to Cohen et al. discloses a coin operated basketball game including side-by-side baskets, shooting alleys, and ball return channels. Automatic scoring and other features are included. To register scores, three alternate approaches are described: (1) a photoelectric sensing system suspended from the back of the hoop, (2) a single microswitch with a long sensing finger mounted to extend within the perimeter of the hoop, or (3) a plurality of microswitches mounted around the perimeter of the hoop so as to contact a ball passing therethrough.

U.S. Pat. No. 2,999,233 to Dresbach et al. discloses a complex photodetecting system for timing a basketball game wherein a source and lens mounted on the backboard focus light onto a reflector mounted inside the hoop. The light reflected from the reflector is directed to a receiver also mounted on the backboard. The photodetecting system draws electrical power whenever the goal is turned on. A ball passing through the hoop will interrupt the light beam to activate the associated electronic circuitry.

U.S. Pat. No. 2,534,067 discloses a height adjustable basketball goal which may be mounted to the tops of a doors, chairs, fences, and the like. The goal includes a pivotally mounted lever arm connected to a disk extending into the cylinder of the net. The mechanically cumbersome lever arm cooperates with a switch to flash an electrical light on when a shot is made.

The assignee of the present invention has developed and marketed an upscale electronic basketball goal that may be mounted indoors, such as over a door or on a self-supporting pole. The goal is marketed under the trademark HERO HOOPS. The upscale indoor basketball goal includes electronic timing and score keeping functions and displays, as well as sound effects, such as cheering and applause generated by a microprocessor-based control circuit. Scoring, or a made shot, is sensed by a spring-loaded, pivotally mounted elongate arm which extends into the cylinder formed by the basketball net. When the soft leatherette basketball supplied with the game passes through the net, the arm is moved downwardly thereby activating an electrical switch mounted adjacent the backboard. The electrical switch activates the scoring increment and certain preprogrammed sound effects.

The mechanical and electrical, or optical approaches described above for sensing a made shot cause such basketball novelty goals to be relatively complicated and, therefore, expensive to manufacture.

At the other extreme of sophistication, several novelty basketball goal products have been developed to address the desire of many people to take a simulated basketball shot by tossing a crumpled wad of waste paper into a waste basket. For example, a relatively small novelty backboard and basket adapted to be mounted on the rim of a waste basket has been marketed and sold as the Deluxe Waste•Basket•Ball TM by Poynter Products, Inc. of Cincinnati Ohio and is described in U.S. Pat. No. 3,244,420 to Poynter. The Deluxe Waste•Basket•Ball TM includes no special sound effects or other distinguishing features that provide positive feedback to the shooter for a made basket.

Basketball related amusement products have been developed that are either sophisticated and expensive, or affordable but providing no user feedback. However, the prior art does not provide an intermediate range product that is affordable and still provides user feedback. Applicant is unaware of any novelty basketball goals produced by other individuals or companies that recognize or address the need for such a product.

SUMMARY OF THE INVENTION

The unique novelty basketball goal of the present invention combines the affordability of simpler novelty goals with one or more features of the more upscale goals to provide positive user feedback for a made shot. The "shooter", upon successfully tossing a ball of waste paper or other object through the hoop of the goal, is given immediate positive feedback. The score is accompanied by cheers and applause generated by the electronic sound effects circuitry of the goal. The novelty goal according to the present invention is simple in design, yet is sensitive to relatively light objects, such as a ball of wastepaper, and provides an exciting sound effects feature found typically only on much more expensive and sophisticated novelty basketball goals.

The novelty basketball goal includes a hoop, a net secured to the hoop, a sensor for detecting a made shot, and the electronic sound effects circuitry. The goal may be mounted on the rim of a waste basket or other generally vertically oriented surface. Advantageously, the sensor is suspended from the net by suitable means, such as the pair of wires connecting the sensor to the electronic sound effects circuitry. The sensing of a made shot is accomplished by an inexpensive yet reliable force sensing switch which is preferably positioned in the path of the object passing through the net of the basketball goal. The relatively small size and weight of the sensor and the flexible mounting arrangement permit an object to pass through the net substantially unimpeded by the sensor. Sophisticated photodector-based sensors and mechanically cumbersome lever arms, as used in the prior art, are not needed according to the present invention which instead uses the simple and reliable self-contained force sensing switch. In addition, the sensor and circuitry of the present invention do not consume electrical power continuously as photodetector-based or illuminated scoring systems do.

The force sensing switch is a self-contained unit that preferably includes a plastic housing and two electrical conductors. The two conductors are suspended in the housing in a closely spaced-apart relation. The preferred force sensing switch used in the novelty basketball goal of the invention can be both sensitive and inexpensive. Thus, the force applied to the sensor housing, such as caused by an impact from a ball of waste paper, produces relative movement of the two conductors of the switch causing the conductors to come into electrical contact. The contact triggers the electronic sound effects circuitry to produce the cheering and applause, thereby simulating the crowd response to a crucial shot by the home team in a real basketball game.

The sound effects generating electronic circuitry includes an inexpensive integrated circuit chip having a stored predetermined sound pattern, such as crowd cheering and/or applause. Generation of the sound effects is triggered by the force sensing switch. The sound effects generating chips are frequently used in other novelty items producing sound effects and are, thus, well known to those having skill in the art.

The basketball goal preferably includes a backboard of transparent or translucent plastic to simulate the appearance of higher quality plexiglass regulation basketball goals. The hoop of the novelty basketball goal is preferably pivotally mounted to the backboard so that the goal may be readily folded into a compact package for storage or carrying. The backboard may also include means for attaching the goal to a vertical surface, such as the edge of a waste paper basket. The attaching means may be a clamp formed by the body of the electronic circuitry housing and a spring-loaded clip pivotally secured to the housing.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein; rather, applicant provides this embodiment so that this disclosure will be thorough and complete, and will fully convey the scope of the invention to those skilled in the art.

Figure 1:
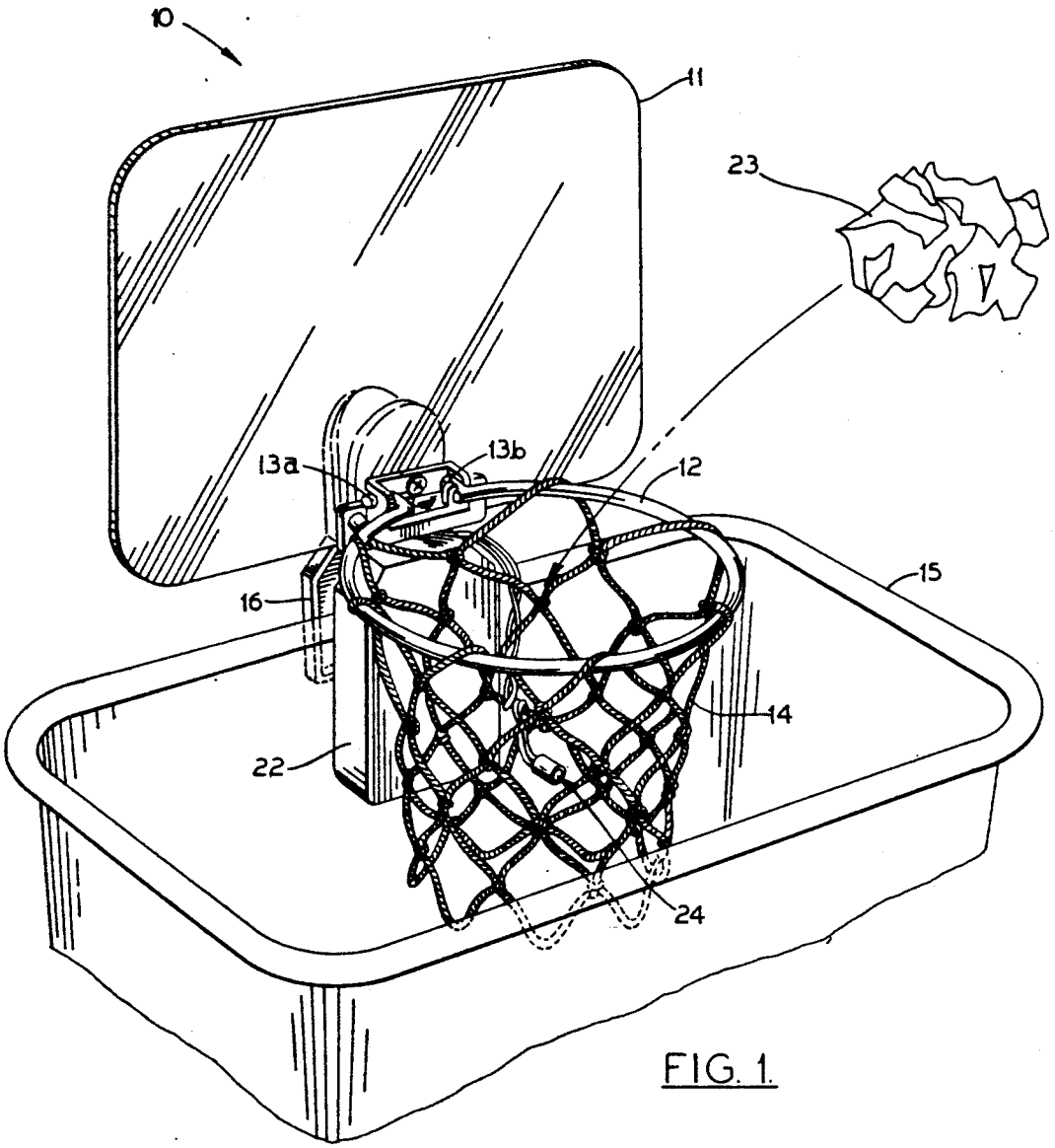
FIG. 1 is a perspective view of a novelty basketball goal according to the present invention positioned on the rim of a waste paper basket.
Figure 2:
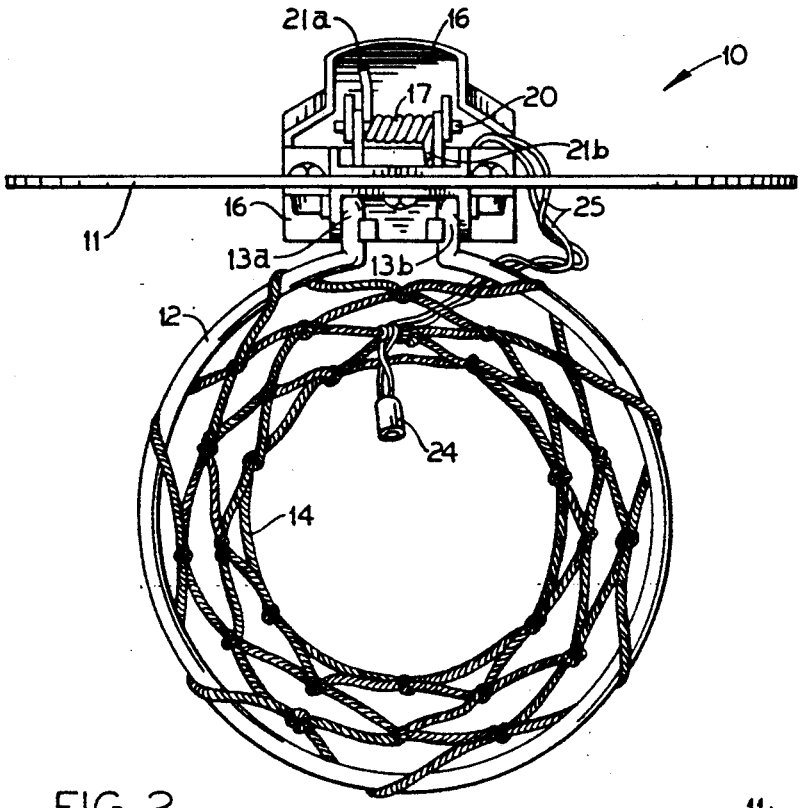
FIG. 2 is a plan view of the novelty basketball goal as shown in FIG. 1.
Figure 3:
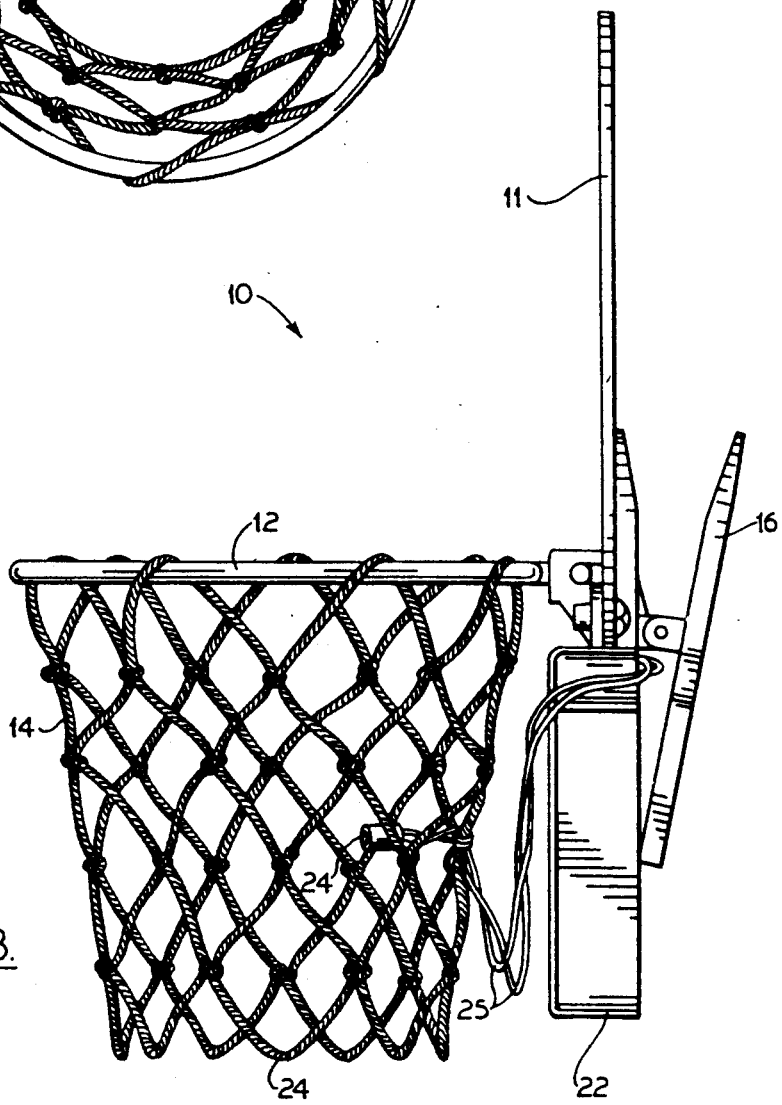
FIG. 3 is a side elevational view of the novelty basketball goal shown in FIG. 1.

Referring to FIGS. 1, 2 and 3, there is shown a novelty basketball goal according to the present invention generally designated as 10. The goal 10 includes a plastic backboard 11 and a plastic hoop 12 pivotally secured to the backboard 11 by two locking hinges 13*a*, 13*b* formed by end portions of the hoop 12. The locking hinges 13*a*, 13*b* permit the hoop 12 to either be extended out from the backboard 11 during normal use, or be folded flush with the backboard 11 for packaging, storing or carrying the goal 10.

The hoop 12 may preferably be circular with a diameter of about 6 inches. While the hoop 12 is shown in a conventional circular shape, it may also be formed in a square, rectangular, oval, or any other shape.

The plastic backboard 11 may preferably be made of a transparent plastic to simulate higher quality plexiglass regulation basketball goals. The backboard 11 may be formed in a rectangular shape approximately 9 inches in width by 7 inches in height simulating a rectangular regulation basketball goal. The backboard may also be a scaled down version of a regulation fan-shaped backboard, not shown.

In an alternate embodiment of the novelty basketball goal not shown, the backboard 11 may be omitted and the hoop 12 be directly mounted to any generally vertical surface, such as a door for example. The vertical surface may function as a backboard, or the hoop 12 may be used without any surface directly behind the hoop in which case only direct shots, or "swishes", may produce a scoring shot.

A generally cylindrically shaped flexible string net 14 is secured to the hoop 12 and adapted to depend therefrom to temporarily capture or slow an object tossed through the hoop 12, just as the net of a regulation basketball goal slows a basketball during a made shot. For a 6 inch diameter hoop 12, a net 14 extending downwardly for about 6 inches is preferred. The hoop 12 may pass through upper loops of the net 14 to secure the net thereto as shown. While the net 14 is shown with a bottom opening to allow an object 23 to pass completely therethrough, it would be readily understood by those having skill in the art, that a net having a closed lower end, not shown, could be used to retain objects 23 successfully tossed through the hoop 12.

As shown in FIG. 1, the novelty basketball goal 10 may be removably secured to the rim of a waste paper basket 15 and the like by a clamp formed by the electronic sound effects housing 22 and a spring-loaded clip 16. The novelty goal 10 may also be readily secured to the top portion of a door, not shown, or any number of other commonplace structures found in the home or office. A simple mounting stand could also be readily made by those having skill in the art to mount the novelty basketball goal 10 according to the present invention.

The spring 17 for the clip 16 is positioned around a retaining pin 20 and the ends of the spring 21*a*, 21*b* oriented to urge an end of the clip 16 toward the sound effects housing 22. Thus, the sound effects housing 22 and the spring-loaded clip 16 form a clamp to secure the basketball goal 10 to the upper lip of a waste paper basket 15 or other vertically oriented surface. The goal 10 may then be used as a practice basket by basketball enthusiasts for shooting an object 23, such as a crumpled ball of waste paper as shown.

The net 14 includes a sensor 24 suspended by a pair of reshapeable wires 25 wrapped around a portion of the net 14. The sensor 24 generates a signal responsive to an object 23 passing through the hoop 12. The reshapeable wires 25 are flexible enough to be readily wrapped around a portion of the net 14, yet stiff enough to maintain the sensor 24 in a desired position in the inner portion of the cylinder of the net 14. As would be readily understood by those having skill in the art, while two individual wires 25 are shown, a single cable containing two conductors or a single wire may also be used depending upon the type of sensor 24 used. For a hoop 12 having a 6 inch diameter, the sensor 24 may be cylindrical having a length of about ⅜ of an inch and a diameter of about ¼ of an inch. The relatively small size of the sensor 24 and the suspension from the flexible net 14 permits an object 23 to pass through the net 14 substantially unimpeded by the sensor 24.

The relatively simple mechanical suspension of the sensor 24 from the net 14, provides a great reduction in the manufacturing cost of the goal 10 as compared to prior art mechanical lever and photodetecting systems. The simple mechanical suspension of the sensor 24 also allows the user to readily set up the novelty basketball goal 10 and begin to use it almost immediately. In contrast, many prior art goals, such as described in U.S. Pat. No. 4,013,292 to Cohen for example, are essentially arcade amusements which require a large amount of space, proper lighting, routine maintenance, special novelty basketballs, and connection to 120 VAC power. The novelty basketball goal 10 according to the present invention is directed to a market segment that has heretofore been ignored by the industry—an inexpensive novelty basketball goal that provides positive user feedback by its detection of a made shot and crowd cheering and applause sound effects responsive thereto.

The sensor 24 is preferably positioned within the interior of the net 14 and suspended from the backboard side thereof so that wires 25 to the sensor 24 are obscured from the front of the goal 10 to enhance the overall aesthetics of the goal 10. The sensor 24 so positioned within the net 14 is most sensitive to made shots rather than to errant shots striking the outer portion of the net 14, especially along the front portion of the net 14. In an alternate embodiment of the invention, not shown, a self-contained sensor may be suspended below the hoop without connection to the flexible net, as long as an object passing through the hoop will contact the sensor.

Figure 4:
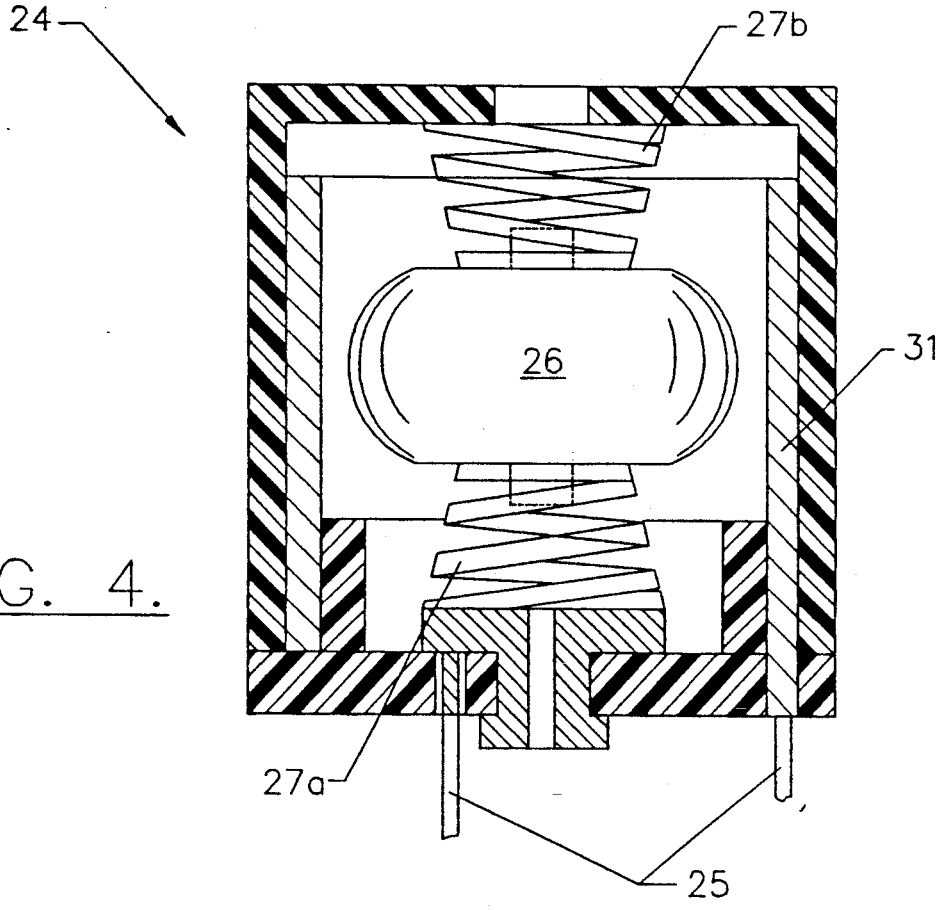
FIG. 4 is a cross-sectional view of the self-contained force sensing switch used to detect a made shot according to the present invention.

Referring to FIG. 4, the sensor 24 may be an electrical force sensing switch of the type commonly used to sense a shock, vibration, or impact. The switch 24 includes a solid electrically conductive body 26 positioned between two springs 27*a*, 27*b* within a hollow cylindrical insulating plastic housing 30. Surrounding the solid conductive body 26, and lining the interior of the insulating housing 30, is a cylindrical conductor 31.

When the sensor 24 is subjected to a force, such as caused by an object 23 tossed into the hoop 12 through the net 14 and striking the sensor 24, relative movement is induced between the solid conductive body 26 and the outer conductor 31 causing an electrical connection to be established therebetween. The sensor 24 suspended within the net 12 provides a sensitive, yet reliable and rugged triggering mechanism for the goal 10. While the specific force actuated switch 24 has been described in detail, many other types of self-contained force sensors may be used in its place as would be readily understood by those having skill in the art. For example, a piezoelectric sensing element, or a resistance-type strain gauge may also be used as a self-contained force actuated sensor 24.

Figure 5:
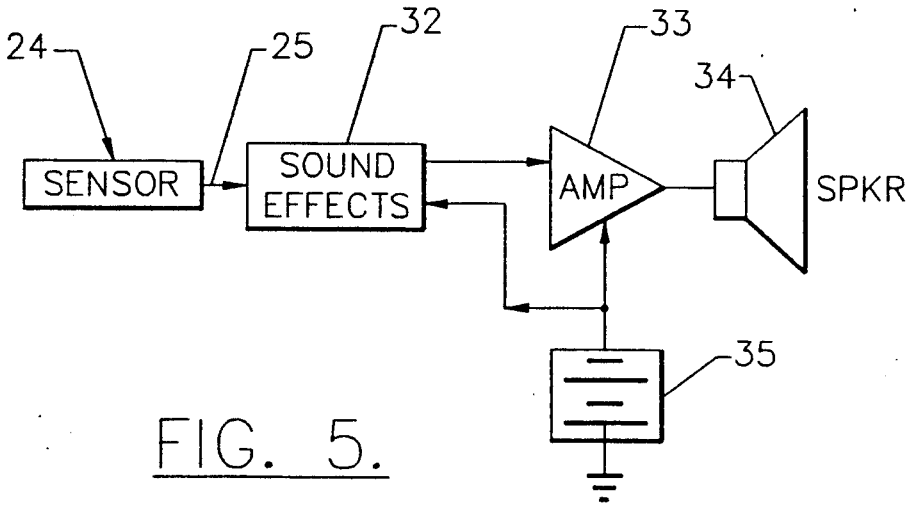
FIG. 5 is an electrical block diagram of the electronic circuitry of the novelty basketball goal according to the present invention.

The sensor 24 is connected to electronic circuitry for generating a predetermined pattern of sound effects responsive to the sensor 24 sensing the passage of an object 23 through the net 14. The circuitry is mounted within the sound effects housing 22. The overall electronic circuitry is represented in the electrical block diagram of FIG. 5. In addition to the sensor 24 and interconnecting wires 25, the circuitry includes an integrated circuit 32 for producing a predetermined audio sound effects pattern, such as crowd cheers and applause, responsive to the sensor 24. The sound effects signal produced by the sound effects integrated circuit 32 is amplified by an audio amplifier 33 and is then played through a loudspeaker 34 mounted within the housing 22. The sound effects are terminated after a predetermined time and the sensor 24 may then trigger another performance of the sound effects for the next made shot.

The construction and operation of a sound effects integrated circuit 32 and audio amplifier 33 for producing sound effects for novelty items are well known to those skilled in the art and are, therefore, not described further herein. The electronic circuitry is preferably powered by one or more batteries 35 which may be disposed within the housing 22. The electronic circuitry draws electrical power from the batteries 35 only when activated by the sensor 24—unlike the photodetector systems of the prior art. Thus, the novelty basketball goal 10 according to the present invention is always "on", that is, ready to produce sound effects responsive to a made shot.

Many modifications and other embodiments of the invention will come to one skilled in the art having the benefit of the teachings presented in the foregoing descriptions and the associated drawings. Therefore, it is to be understood that the invention is not to be limited to the specific embodiment disclosed, and that modifications and embodiments can be made within the spirit and teachings of the present invention as described herein and are intended to be included within the scope of the appended claims.

That which is claimed is:

1. A novelty basketball goal comprising:
- a hoop;
- a net secured to the hoop;
- an electrical switch for generating a signal responsive to an object passing through the hoop, the electrical switch comprising
  - a housing;
  - a first conductor and a second conductor positioned within the housing; and
  - means for suspending the first conductor within the housing in a closely spaced-apart relation from the second conductor so that the first and second conductors come into contact responsive to a predetermined force applied to the housing;
- means for suspending the electrical switch from the net; and
- means for generating sound effects responsible to the signal from the electrical switch.

2. The novelty basketball goal according to claim 4 wherein the electrical switch is small in relation to the area defined by the hoop, and wherein the electrical switch is flexibly supported by the suspending means and the net so as to permit an object passing through the net to be substantially unimpeded by the electrical switch.

3. The novelty basketball goal according to claim 1 wherein the sound effects generating means comprises an integrated circuit having a predetermined pattern of at least one of crowd applause and crowd cheers stored therein.

4. The novelty basketball goal according to claim 1 further comprising a backboard, and wherein the hoop is pivotally connected to the backboard for permitting the hoop to be folded thereagainst.

5. The novelty basketball goal according to claim 1 further comprising a backboard secured to the hoop, and means for removably securing the backboard to a substantially vertical surface.

6. A novelty basketball goal comprising:

a hoop adapted to be mounted in a generally horizontal plane;

a self-contained force activated sensor positioned below the hoop in a location for contacting an object passing through the hoop, the self-contained force activated electrical sensor comprising a housing:

a first conductor and a second conductor positioned within the housing; and means for suspending the first conductor within the housing in a closely spaced-apart relation from the second conductor so that the first and second conductors come into electrical contact responsive to a predetermined force applied to the housing; and means for generating sound effects responsive to the self-contained force activated sensor.

7. The novelty basketball goal according to claim 6 further comprising a cylindrical net secured to the hoop and adapted to depend therefrom, and wherein the self-contained force activated sensor is positioned within the cylinder defined by the net.

8. The novelty basketball goal according to claim 6 wherein the sound effects generating means comprises an integrated circuit having a predetermined pattern of at least one of crowd applause and crowd cheers stored therein.

9. The novelty basketball goal according to claim 6 further comprising a backboard, and wherein the hoop is pivotally connected to the backboard for permitting the hoop to be folded thereagainst.

10. The novelty basketball goal according to claim 6 further comprising a backboard secured to the hoop, and means for removably securing the backboard to a substantially vertical surface.

11. A novelty basketball goal comprising:

a hoop;

a net secured to the hoop and adapted to depend therefrom;

a force activated switch;

means for generating a predetermined pattern of sound effects responsive to the force activated switch; and at least one wire interconnecting the force activated switch and the sound effects generating means, the wire being passed through a portion of the net so that the force activated switch is positioned in the interior thereof.

12. The novelty basketball goal according to claim 11 wherein the wire is readily reshapeable, and wherein the reshapeable wire is wrapped around a portion of the net for suspending the force activated switch therefrom.

13. The novelty basketball goal according to claim 11 wherein the force activated switch comprises:

a hollow cylindrical housing;

a hollow cylindrical electrical conductor positioned within the housing; and an electrically conductive body suspended within the housing in a closely spaced-apart relation from the hollow cylindrical electrical conductor for electrically contacting same responsive to a predetermined force applied to the housing.

14. The novelty basketball goal according to claim 11 wherein the sound effects generating means comprises an integrated circuit having a predetermined pattern of at least one of crowd applause and crowd cheers stored therein.

15. A method for making a novelty basketball goal adapted to provide shooter feedback for a made shot comprising the steps of:

providing a hoop and a net depending therefrom, and a sound effects generator connected to a force activated sensor; and suspending the force activated sensor from the net so that an object passing through the hoop will impart a force to activate the sensor and the sound effects generator to produce a predetermined pattern of sound effects; and wherein the step of suspending the sensor from the net comprises the step of wrapping a reshapeable wire, interconnecting the sound effects generator and the sensor, around a portion of the net.

* * * * *

UNITED STATES PATENT AND TRADEMARK OFFICE

CERTIFICATE OF CORRECTION

PATENT NO. : 5,064,195

DATED : November 12, 1991

INVENTOR(S) : David S. McMahan, et al.

It is certified that error appears in the above-identified patent and that said Letters Patent is hereby corrected as shown below:

Col 6, line 53, delete "responsible" and substitute --responsive--.
line 55, delete "Claim 4" and substitute --Claim 1--.

Signed and Sealed this

Sixth Day of April, 1993

*Attest:*

STEPHEN G. KUNIN

*Attesting Officer*

*Acting Commissioner of Patents and Trademarks*